United States Patent [19]

Way et al.

[11] 4,078,412

[45] * Mar. 14, 1978

[54] SUPPORT SHOES AND METHODS OF SUPPORTING METAL MEMBERS SUCH AS SEAMLESS TUBES

[75] Inventors: Lewis A. Way; Robert C. Williams, both of Columbiana, Ohio

[73] Assignee: Columbiana Foundry Company, Columbiana, Ohio

[ * ] Notice: The portion of the term of this patent subsequent to Jun. 15, 1993, has been disclaimed.

[21] Appl. No.: 702,687

[22] Filed: Jul. 6, 1976

Related U.S. Application Data

[63] Continuation-in-part of Ser. No. 36,406, May 11, 1970, Pat. No. 3,962,897.

[51] Int. Cl.[2] ..... B21B 39/00

[52] U.S. Cl. ..... 72/250

[58] Field of Search ..... 72/97, 208, 209, 250; 75/171, 128 R

[56] References Cited

U.S. PATENT DOCUMENTS

| | | | |
|---|---|---|---|
| 1,903,952 | 4/1933 | Wissler | 75/171 |
| 2,263,020 | 11/1941 | Trantin, Jr. | 75/128 R |
| 2,958,244 | 11/1960 | Rodder | 72/97 |

OTHER PUBLICATIONS

Metals Handbook, 1948 Ed., p. 63.

*Primary Examiner*—Milton S. Mehr
*Attorney, Agent, or Firm*—Buell, Blenko & Ziesenheim

[57] ABSTRACT

A support shoe and a method are provided for supporting metal members being formed at high temperatures, particularly during piercing and reeling of seamless tube, by the steps of passing said member, over one or more supporting shoes positioned to support the metal member, particularly while said member passes between the rolls of the piercing mill and/or the reeling mill with said shoe being formed of an alloy comprising 0.015% to 1.5% carbon, about 35% to 65% cobalt, about 15% to 35% chromium and up to about 25% iron and amounts of boron, nickel, silicon, molybdenum, vanadium, aluminum, tantalum, tungsten, titanium, copper and columbium for imparting the qualities generally associated therewith without detrimentally affecting the hot hardness and resistance to erosion of said alloy at said elevated temperature.

8 Claims, No Drawings

SUPPORT SHOES AND METHODS OF SUPPORTING METAL MEMBERS SUCH AS SEAMLESS TUBES

This application is a continuation-in-part of our copending application Ser. No. 36,406, filed May 11, 1970, now U.S. Pat. No. 3,962,897.

This invention relates to support shoes and methods of supporting metal members such as seamless tubes at high temperature, particularly where said metal members are being hot worked in contact with the support shoe such as in piercing or reeling.

The manufacture of seamless tube and pipe using piercer points, pipe plugs and reeler plugs is well known.

A hollow tube above mentioned is formed by first feeding a heated billet over a piercer point between rolls which force the billet over the piercer point while forming the outer periphery of the pipe. Typically this operation is carried out on a Mannesmann piercing mill having two double conical rolls, each set at an angle to the work piece. A billet at about 2300° F. is fed into the mill until engaged by the rolls which start it spinning. Since the rolls are set at an angle to the path of the billet, one component of force is in the longitudinal direction which pulls the billet forward onto the piercing point. The metal then flows along both sides of the piercer point forming a tube. After each billet is formed the piercer point is quenched in water. Thus the piercer point operates under extreme conditions of thermal shock, compression, wear, impact, longitudinal and torsional stress.

During the time the billet is being pierced in the piercing mills and later during the process when the pierced tube is being reeled in the reeling mill, the tube is supported on shoes or guides which are subject to the same extremes of temperature and shock. In the past, such support shoes have been made of cast iron or an alloy steel containing substantial amounts of chromium and nickel. A typical analysis for a shoe used in the piercing mill in conventional operations is 0.79% carbon, 0.96% silicon, 1.57% manganese, 24.13% chromium, 14.79% nickel and the balance iron. The normal life expectancy of this conventional piercer shoe in one of the major pipe mills is about 200 pieces. After this the shoe has worn excessively and it must be replaced. Another problem with conventional support shoes is the problem of "pick-up" which is the condition where oxide particles from the billet or pipe adhere to the shoe and build up to the point where they abrade the outside of the pipe. This causes objectionable scratches and marks on the pipe.

We have discovered an apparatus and method of supporting metal members being formed at elevated temperature such as in a piercing mill or a reeling mill. Our support shoe and method not only has vastly increased service or work life and is not subject to the problem of "pick-up" which characterized prior art practices. Preferably such members are made of a composition relatively low in iron but high in cobalt. Compositions for use in such members lie in the broad range as follows:

C: 0.015% - 1.5%
Co: 35% - 65%
Cr: 15% - 35%
Fe: 0% - 25%

In the foregoing composition we have found that cobalt is absolutely essential to extended shoe life and elimination of "pick-up" and scratching. We have also found that boron, molybdenum, tungsten, titanium, nickel, copper, vanadium, aluminum and tantalum and columbium may be present for imparting the qualities generally associated with such elements without detrimentally affecting the alloy.

A preferred composition range including auxiliary alloys for supporting metal members being formed in the piercing mill is:

C about 0.015% to 1.5%
Co about 35% to 65%
Cr about 15% to 35%
Fe up to about 25%
Ni up to about 15%
Mo up to about 15%
W up to about 18%
Si up to about 1.5%
Mn up to about 1%

The subject matter of this invention may perhaps best be understood by reference to the following examples.

In a major mill for producing seamless tubes in which the average life for a piercer support shoe is 200 pieces for the standard analysis of shoe, comparative tests on piercer support shoes according to this invention gave the results set out in Table I.

TABLE I

| Shoe | Analysis | | | | | | | | | | Life | |
|---|---|---|---|---|---|---|---|---|---|---|---|---|
| Test | C | Si | Mn | Cr | Ni | Co | W | Mo | Cb | Fe | Ave. | Remarks |
| (1) | 0.79 | 0.96 | 1.57 | 24.13 | 14.79 | — | — | — | — | Bal. | 200 pcs. | Standard |
| (2) | 0.56 | 0.68 | 0.75 | 30.13 | — | 46.29 | — | — | 2.47 | 21.5 | 425 pcs. | |
| (3) | 1.45 | 0.35 | 0.75 | 31.96 | 9.9 | 55.26 | — | — | — | 2.84 | 162 pcs. | |
| (4) | 0.60 | 0.46 | 0.65 | 26.27 | 11.45 | 52.13 | 7.76 | — | — | 2.39 | 511 pcs. | |

The results show that the support shoes of this invention (2) and (3) produced more than double the average number produced by the industry standard shoe (1). Shoe (3) fell short of the conventional shoe in this test because it was less resistant to the thermal shock.

In the same mill, reeler support shoes of the analysis conventionally used in the industry average about 500 to 600 pieces. Comparative tests on reeler support shoes according to this invention gave the results set out in Table II.

TABLE II

| Shoe | Analysis | | | | | | | | | | Life | Remarks |
|---|---|---|---|---|---|---|---|---|---|---|---|---|
| Test | C | Si | Mn | Cr | Ni | Co | W | Mo | Cb | Fe | | |
| (1) | 3.40 | 1.50 | 0.60 | 0.25 | 0.20 | — | — | — | — | Bal. | 500-600 pcs. | Standard |
| (2) | 0.06 | 0.37 | 0.51 | 20.10 | 12.25 | 50.56 | 14.88 | — | — | 2.31 | 4500+pcs. | Still good |
| (3) | 0.40 | 0.36 | 0.59 | 26.83 | — | 61.96 | 6.78 | — | — | 4.43 | 4300+pcs. | Still good |
| (4) | 0.11 | 0.70 | 0.70 | 29.97 | — | 47.54 | — | — | — | 22.46 | 3700 pcs. | |

TABLE II-continued

| Shoe Test | Analysis C | Si | Mn | Cr | Ni | Co | W | Mo | Cb | Fe | Life | Remarks |
|---|---|---|---|---|---|---|---|---|---|---|---|---|
| (5) | 0.022 | 0.31 | 0.57 | 15.93 | 13.95 | 57.39 | 5.42 | 5.05 | — | 2.18 | 1800 pcs. | |

The results show that reeler support shoes of this invention (2) to (5) produced from 3 to 9 times more product than the standard shoe of the industry.

From the foregoing examples it will be evident that the support shoes and method of supporting metal at elevated temperature during working according to this invention will produce many more pieces without changing shoes than is the case with conventional practice.

While we have illustrated certain preferred embodiments and practices of our invention it will be understood that this invention may be otherwise practiced within the scope of the following claims.

We claim:

1. A method of supporting metal members being formed at elevated temperatures such as during piercing and enlarging a seamless tube, comprising the steps of passing said metal member at an elevated temperature over one or more supporting shoes positioned to support said member, said support shoe being formed of an alloy consisting essentially of 0.015% to 1.5% carbon, about 35% to 65% cobalt, about 15% to 35% chromium, up to about 25% iron and amounts of boron, nickel, silicon, molybdenum, vanadium, aluminum, tantalum, tungsten, titanium, copper and columbium for imparting the qualities generally associated therewith without detrimentally affecting the hot hardness and resistance to erosion of said alloy at said elevated temperature.

2. A method of supporting metal members as claimed in claim 1 wherein the alloy contains the following amounts of other constituents up to about 15% nickel, up to about 15% molybdenum, up to about 18% tungsten, up to about 1% manganese and up to about 1.5% silicon.

3. A method of supporting metal members as claimed in claim 1 wherein the alloy contains the following amounts of other constituents about 2% to 20% nickel, about 1.5% to 6% molybdenum, up to about 1% manganese and up to about 1.5% silicon.

4. A method of piercing and enlarging metal members as claimed in claim 1 wherein the alloy contains the following amounts of additional constituents up to about 25% iron, up to about 15% nickel, up to about 18% tungsten, up to about 1% manganese and up to about 1.5% silicon.

5. A support member having a surface adapted for moving contact on a moving metal member at elevated temperature to be supported consisting essentially of about 0.015% to 1.5% carbon, about 35% to 65% cobalt, about 15% to 35% chromium, up to about 25% iron and amounts of boron, nickel, silicon, molybdenum, vanadium, aluminum, tantalum, tungsten, titanium, copper and columbium for imparting the qualities generally associated therewith without detrimentally affecting the hot hardness and resistance to erosion of said alloy at said elevated temperature.

6. A support member as claimed in claim 5 containing the following amounts of additional constituents up to about 25% iron, up to about 15% nickel, up to about 15% molybdenum, up to about 18% tungsten, up to about 1% manganese and up to about 1.5% silicon.

7. A support member as claimed in claim 5 containing the following amounts of additional constituents up to about 25% iron, about 2% to 20% nickel, about 1.5% to 6% molybdenum, up to about 1% manganese and up to about 1.5% silicon.

8. A support member as claimed in claim 5 containing the following amounts of additional constituents up to about 25% iron, up to about 15% nickel, up to about 18% tungsten, up to about 1% manganese and up to about 1.5% silicon.

* * * * *